US005704141A

United States Patent [19]

Miura et al.

[11] Patent Number: 5,704,141

[45] Date of Patent: Jan. 6, 1998

[54] CONTACT PREVENTION SYSTEM FOR A BACKHOE

[75] Inventors: Keisuke Miura; Eiji Nishi, both of Sakai, Japan

[73] Assignee: Kubota Corporation, Osaka, Japan

[21] Appl. No.: 548,655

[22] Filed: Oct. 26, 1995

Related U.S. Application Data

[63] Continuation-in-part of Ser. No. 144,865, Oct. 28, 1993, abandoned.

[30] Foreign Application Priority Data

Nov. 9, 1992 [JP] Japan ..... 4-297511

[51] Int. Cl.[6] ..... E02F 5/02

[52] U.S. Cl. ..... 37/348; 364/424.07; 414/699

[58] Field of Search ..... 37/348, 414, 906, 37/907, 234; 364/424.07, 424.05; 414/687, 694, 599; 91/392

[56] References Cited

U.S. PATENT DOCUMENTS

| | | | |
|---|---|---|---|
| 3,636,325 | 1/1972 | Chytil | 37/348 X |
| 4,037,742 | 7/1977 | Gustafsson | 414/699 X |
| 4,889,466 | 12/1989 | Jindai et al. | 414/694 |
| 5,011,358 | 4/1991 | Anderson et al. | 364/424.07 X |
| 5,028,199 | 7/1991 | Ikari et al. | 414/699 |
| 5,088,020 | 2/1992 | Nishida et al. | 414/699 X |
| 5,136,928 | 8/1992 | Hachisa | 91/392 |
| 5,178,510 | 1/1993 | Hanamoto et al. | 414/694 |
| 5,297,019 | 3/1994 | Zuehlike | 364/424.07 X |
| 5,335,176 | 8/1994 | Nakamura | 364/424.05 |
| 5,347,448 | 9/1994 | Nam | 364/424.07 X |
| 5,356,259 | 10/1994 | Hanamoto et al. | 37/348 X |
| 5,359,542 | 10/1994 | Pahmeier et al. | 364/424.07 X |
| 5,490,081 | 2/1996 | Kuromoto et al. | 364/424.07 X |

FOREIGN PATENT DOCUMENTS

| | | |
|---|---|---|
| A-0419667 | 4/1991 | European Pat. Off. . |
| 41 10959A1 | 10/1991 | Germany . |
| 41 10978A1 | 10/1991 | Germany . |
| 41 10991A1 | 10/1991 | Germany . |
| 2221524 | 9/1990 | Japan . |
| 3208923 | 9/1991 | Japan . |
| 4202920 | 7/1992 | Japan . |
| A-2222997 | 3/1990 | United Kingdom . |
| 2 242 886 | 10/1991 | United Kingdom . |
| 2 243 359 | 10/1991 | United Kingdom . |
| 2243141 | 10/1991 | United Kingdom . |
| 2275462 | 8/1994 | United Kingdom . |

*Primary Examiner*—Terry Lee Melius
*Assistant Examiner*—Victor Batson
*Attorney, Agent, or Firm*—Townsend and Townsend and Crew LLP

[57] ABSTRACT

A backhoe having a swivel deck supporting a driver's section and a hydraulically operable boom assembly. This backhoe includes a detecting device for detecting a position, direction of movement and velocity of movement of a bucket relative to the driver's section, and a control device for controlling the boom assembly based on detection values provided by the detecting device. The control device has a function to prohibit operation of the bucket when the bucket moves inwardly of a danger plane A1 or A2 disposed at a predetermined distance outwardly of the driver's section. The control device establishes a caution plane C1 or C2 disposed at a predetermined distance outwardly of the danger plane A1 or A2, and has a time estimating function which, when a bucket pin 6a lies in a danger zone B1 or B2 defined by the danger plane and caution plane, computes and estimates time taken for the bucket 6 to reach the danger plane A1 or A2. To realize an ideal decelerated motion, a set time is determined in advance by using a horizontal distance to the danger plane A1 or A2 as a variable. The control device has a decelerating function to decelerate operation of hydraulic cylinders so that the set time and the time estimated agree.

9 Claims, 10 Drawing Sheets

CONTACT PREVENTION SYSTEM FOR A BACKHOE

This is an FWC Continuation-in-Part of application Ser. No. 08/144,865, filed Oct. 28, 1993, now abandoned.

BACKGROUND OF THE INVENTION

1. Field of the Invention

The present invention relates to a system for preventing a bucket of a backhoe from contacting an outer frame defining an outermost region of a driver's section.

2. Description of the Prior Art

An example of backhoe structure designed to avoid contact between a bucket and an outer frame defining an outermost region of a driver's section is disclosed in U.K. Patent Application No. 91 04823.1, which is illustrated in FIG. 7 of the present application as well.

In the illustrated prior structure, a danger plane is established in a space and at a predetermined distance outwardly of the outer frame defining the outermost region of the driver's section. A position sensor detects position of a bucket pin of a boom assembly. An operation prohibiting device is provided which is operable in response to the position sensor. This device stops hydraulic cylinders which drive the boom assembly, before the bucket pin moves past the danger plane toward the driver's section.

This structure defines a danger zone between the danger plane and a caution plane established in a space and at a predetermined distance outwardly of the danger plane. A decelerating device computes a distance in a horizontal direction from the danger plane to a current position of the bucket pin, and decelerates operation of the hydraulic cylinders by the greater degree as the bucket pin moves closer to the danger plane.

In this prior structure, when the bucket pin lies in the danger zone, a deceleration rate of the hydraulic cylinders is determined only on the basis of a horizontal distance from the danger plane to the bucket pin. Consequently, when the bucket pin moves substantially horizontally from a given position in the danger plane toward the danger plane, the hydraulic cylinders are decelerated at the deceleration rate based on the horizontal distance to the danger plane. The hydraulic cylinders are stopped when the bucket pin reaches the danger plane. Such an operation of the boom assembly agrees with the operating feeling of the driver.

According to the prior structure, the deceleration rate is determined by the horizontal distance to the danger plane also when the bucket pin moves obliquely upward and gradually from a given position in the danger zone toward the danger plane. Although the bucket pin moves a relatively long distance (in an obliquely upward direction) to the danger plane, the hydraulic cylinders are decelerated as in the case of horizontal movement of the bucket pin. As a result, the bucket is raised through the danger zone a little too slowly. Thus, there is room for improvement from the viewpoint of operating efficiency.

SUMMARY OF THE INVENTION

The object of the present invention is to provide improved operating efficiency for a backhoe having the above danger plane and danger zone concept, especially when the bucket lies in the danger zone.

The above object is fulfilled, according to the present invention, by a backhoe comprising a first setting device for setting a danger plane in a space and at a predetermined distance outwardly of an outer frame defining an outermost region of a driver's section disposed on a swivel deck, a second setting device for setting a danger zone between the danger plane and a plane in a space and at a predetermined distance outwardly of the danger plane, a position sensor for detecting a position of a bucket of a boom assembly, a direction sensor for detecting a direction of movement of the bucket, a velocity sensor for detecting a velocity of movement of the bucket, a safety device operable in response to the position sensor and the direction sensor to stop boom assembly driving hydraulic cylinders to prevent the bucket from moving past the danger plane toward the driver's section, and a decelerating device operable in response to the position sensor, direction sensor and velocity sensor, when the bucket lies in the danger zone, to decelerate operation of the hydraulic cylinders to substantially equalize time taken for the bucket to move from a current position thereof in the danger zone to the danger plane regardless of the direction of movement of the bucket as long as the bucket is moving towards the danger plane (A1, A2) in the danger zone. Note, however, that the decelerating device remains inoperative when the bucket lies in the danger zone and moves away from the driver's section.

With the above construction, when the bucket lies in the danger zone, for example, the sensors detect a current position, direction of movement and velocity of movement of the bucket. It is then possible to compute a horizontal distance L1 from the current bucket position to the danger plane or a moving distance L2 along the direction of movement to the danger plane. Assuming that the bucket is uniformly decelerated from the current velocity of movement, it is possible to estimate time taken for the bucket to move the distance L1 or L2 from the current position to the danger plane.

The hydraulic cylinders are decelerated to equalize the above estimated time to a set time in an instantaneous position of the bucket (the set time being a function of stopping time with respect to distance where a minimum distance between the danger plane and bucket is used as a variable and the bucket is assumed to make an ideal decelerated motion).

Thus, when the bucket moves horizontally in the danger zone, the distance L1 from the bucket to the danger plane is expected to be relatively short so that the bucket reaches the danger plane relatively quickly. In this case, the boom assembly driving hydraulic cylinders are decelerated by an increased degree whereby the bucket reaches the danger plane upon lapse of the set time.

Conversely, when the bucket lies in the same position as above but momentarily moves obliquely upward or downward, the distance L2 from the bucket to the danger plane is relatively long. In this state, the bucket is expected to consume a relatively long time before reaching the danger plane under the ordinary deceleration control noted above. However, the boom assembly driving hydraulic cylinders are decelerated only by a small degree to cause the bucket to reach the danger plane upon lapse of the above set time.

Thus, the present invention avoids an excessive deceleration of the bucket when the bucket moves a relatively long distance (the distance along the direction of movement of the bucket) to the danger plane as when the bucket moves obliquely upward and gradually from a given position in the danger zone toward the danger plane.

According to the present invention, as described above, the position, direction of movement and velocity of movement of the bucket in the danger zone are detected in order to prevent the bucket movement from becoming too slow, thereby to improve the operating efficiency of the bucket.

Other features and advantages of the invention will be apparent from the following more particular description of preferred embodiments of the invention, as illustrated in the accompanying drawings.

DETAILED DESCRIPTION OF THE PREFERRED EMBODIMENTS

Embodiments of the present invention will be described hereinafter with reference to the drawings.

Figure 1:
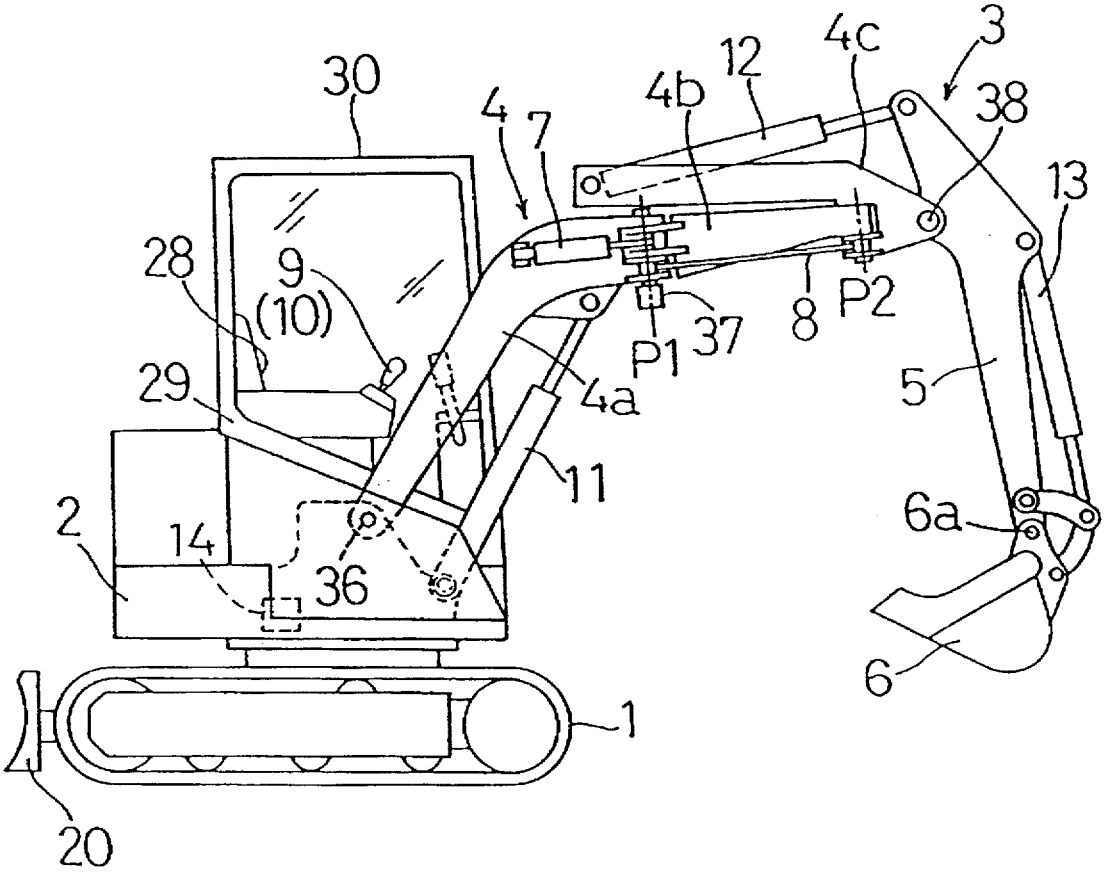
FIG. 1 is a side elevation of a backhoe.

FIG. 1 shows a side elevation of a backhoe. This backhoe has a rubber crawler type running device 1 carrying a bulldozer blade 20, and a swivel deck 2 mounted on the running device 1. A boom assembly 3 is connected to a front position of the swivel deck 2. The boom assembly 3 includes a boom 4 vertically pivotable by a hydraulic cylinder 11, an arm 5 pivotable back and forth by a hydraulic cylinder 12, and a bucket 6 pivotable by a hydraulic cylinder 13 to take shoveling action. The swivel deck 2 is swivelable by a hydraulic motor 14.

Figure 4:
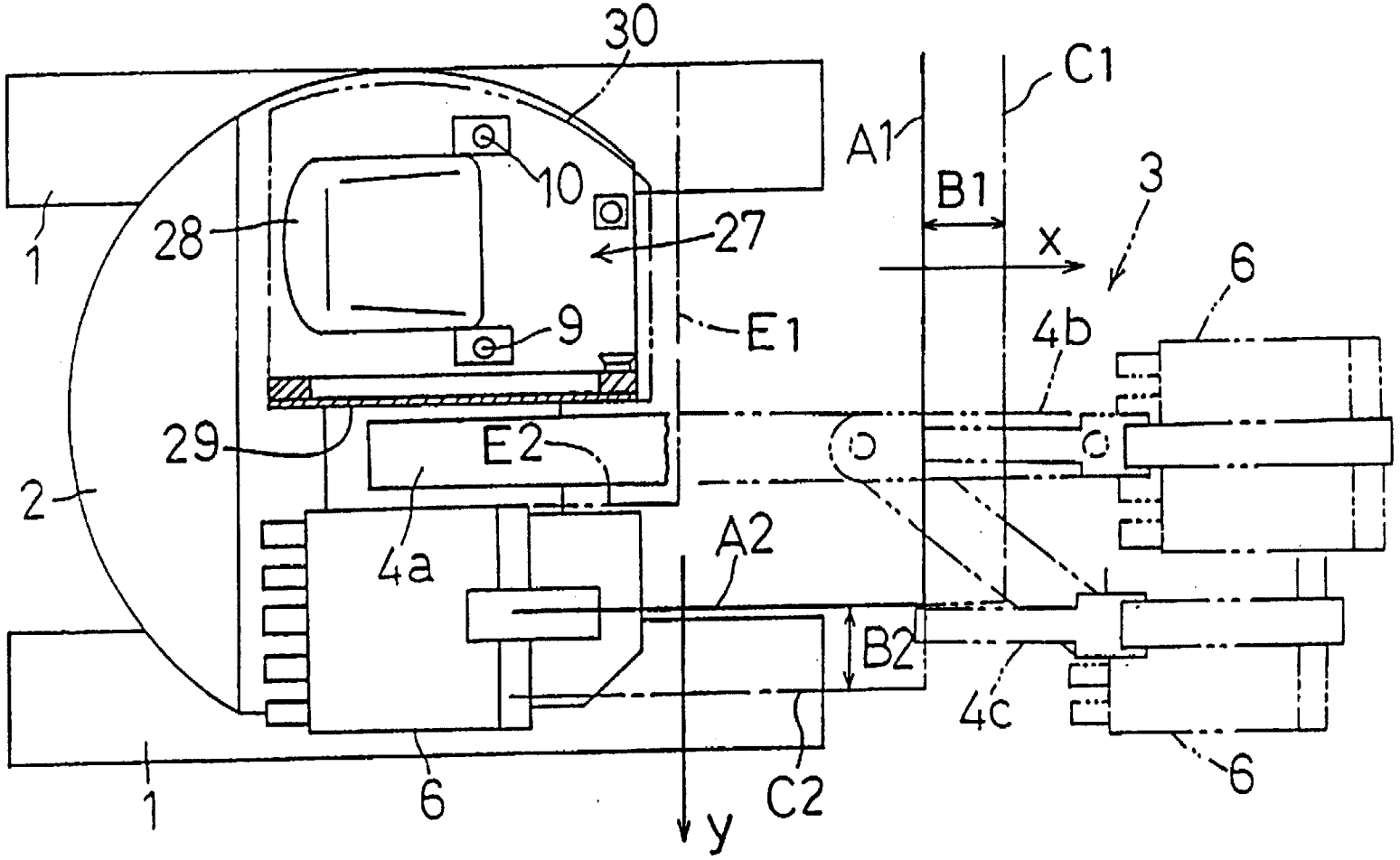
FIG. 4 is a schematic plan view of the backhoe, showing the front danger plane, a side danger plane, the front danger zone and a side danger zone.

As shown in FIGS. 1 and 4, the boom 4 includes a vertically pivotable first boom portion **4*a*, a second boom portion 4*b* connected to the first boom portion 4*a* to be pivotable about an axis P1 at a forward end thereof, and a support bracket 4*c* connected to the second boom portion 4*b* to be pivotable about an axis P2 at a forward end thereof. The arm 5 is connected to the support bracket 4*c*. An interlocking link 8 extends between the first boom portion 4*a* and support bracket 4*c* to constitute a parallelogram link mechanism. Thus, when the hydraulic cylinder 7 is operated to cause pivotal movement of the second boom portion 4*b*, the arm 5 and bucket 6** are moved sideways in parallel.

Figure 5:
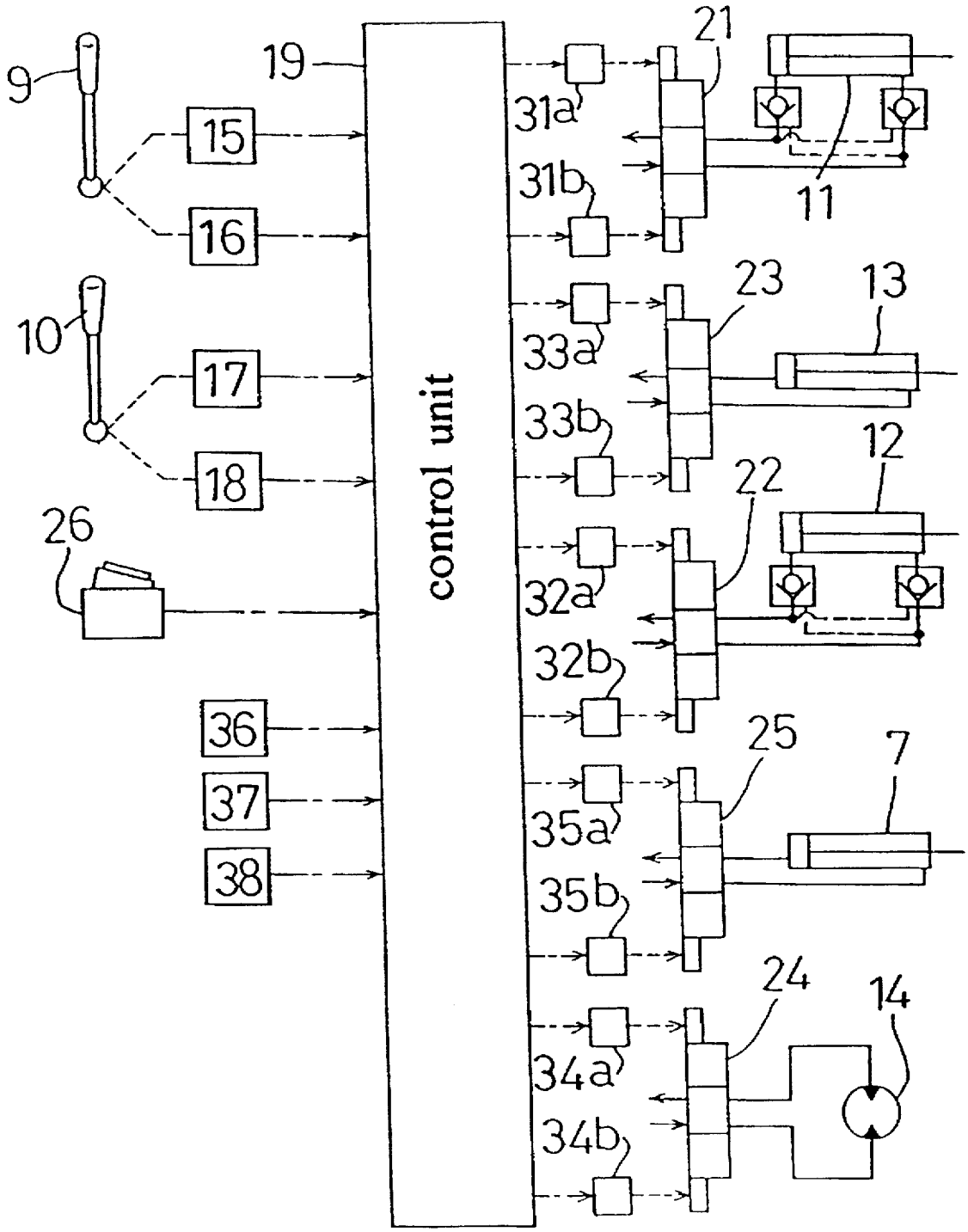
FIG. 5 is a view showing relations among hydraulic cylinders, control valves pilot valves and right and left control levers of a boom assembly.

As shown in FIG. 5, a control system includes a control valve 21 connected to the hydraulic cylinder 11 for actuating the first boom portion **4*a*, a control valve 25 connected to the hydraulic cylinder 7 for actuating the second boom portion 4*b*, a control valve 22 connected to the hydraulic cylinder 12 for actuating the arm 5, a control valve 23 connected to the hydraulic cylinder 13 for actuating the bucket 6, and a control valve 24 connected to the hydraulic motor 14 for swiveling the swivel deck 2. These control valves 21–25 are pilot-operated three-position valves whose opening degrees are adjustable by pilot pressure to control flow rate. Opening degree adjusting pilot pressures are generated by pilot valves 31*a*, 31*b*, 32*a*, 32*b*, 33*a*, 33*b*, 34*a*, 34*b*, 35*a* and 35*b*** which are electromagnetic proportional pressure reducing valves.

Referring to FIGS. 1, 4 and 5, the swivel deck 2 carries a right control lever 9 and a left control lever 10. These control levers 9 and 10 are rockable fore and aft and right and left. The control system further includes a potentiometer 15 for detecting a position in the fore and aft direction of the right control lever 9, a potentiometer 16 for detecting a position in the right and left direction of the right control lever 9, a potentiometer 17 for detecting a position in the fore and aft direction of the left control lever 10, and a potentiometer 18 for detecting a position in the right and left direction of the left control lever 10. These potentiometers 15–18 transmit control signals to a control unit 19. A control pedal 26 is disposed in a lower front position of the swivel deck 2, which also transmits a control signal to the control unit 19.

According to the above construction, when the right control lever 9 is operated forward or backward, the pilot valve **31*a* or 31*b* generates a pilot pressure for causing the control valve 21 to lower or raise the boom 4. When the right control lever 9 is operated right or left, the pilot valve 33*a* or 33*b* generates a pilot pressure for causing the control valve 23 to actuate the bucket 6 in an earth pushing direction or a rake-in direction. When the left control lever 10 is operated forward or backward, the pilot valve 32*a* or 32*b* generates a pilot pressure for causing the control valve 22 to actuate the arm 5 forward or backward. When the left control lever 10 is operated right or left, the pilot valve 34*a* or 34*b* generates a pilot pressure for causing the control valve 24 to effect a right or left swivel of the swivel deck 2. When the control pedal 26 is depressed right or left, the pilot valve 35*a* or 35*b* generate a pilot pressure for causing the control valve 25 to swing the second boom portion 4*b*** rightward or leftward.

In the above operation, the potentiometers 15–18 detect not only the directions of operation of the right and left control levers 9 and 10 but also amounts of operation thereof from respective neutral positions. Consequently, the larger the amount of operation of the control levers 9 and 10, the higher pilot pressure is generated by the pilot valves **31*a*–34*b* to operate the control valves 21–24 for the higher flow rate. That is, the larger the amount of operation of the control levers 9 and 10, the faster the hydraulic cylinders 11–13 and hydraulic motor 14** are operated.

Referring to FIGS. 1 and 5, the control system further includes a potentiometer 36 (acting as position, direction and velocity detecting means) for detecting a vertical angle of the boom 4 (first boom portion **4*a*), a potentiometer 37 (acting as position, direction and velocity detecting means) for detecting a horizontal angle of the second boom portion 4*b*, and a potentiometer 38 (acting as position, direction and velocity detecting means) for detecting a fore and aft angle of the arm 5. These potentiometers 36–38 transmit detection signals to the control unit 19**.

As shown in FIGS. 1 and 4, the swivel deck 2 has the boom assembly 3 disposed on the right side thereof, while on the left side is a driver's section 27 including a driver's seat 28 and the right and left control levers 9 and 10. A vertical partition plate 29 (acting as part of an outer frame defining an outermost region of the driver's section 27) having a window is erected in a transversely middle position on the swivel deck 2 to separate the boom assembly 3 and driver's section 27. A semicircular upper partition plate 30 (acting as part of the outer frame defining the outermost region of the driver's section 27) is fixedly mounted on the vertical partition plate 29 to extend along an outer contour of the swivel deck 2.

Figure 2:
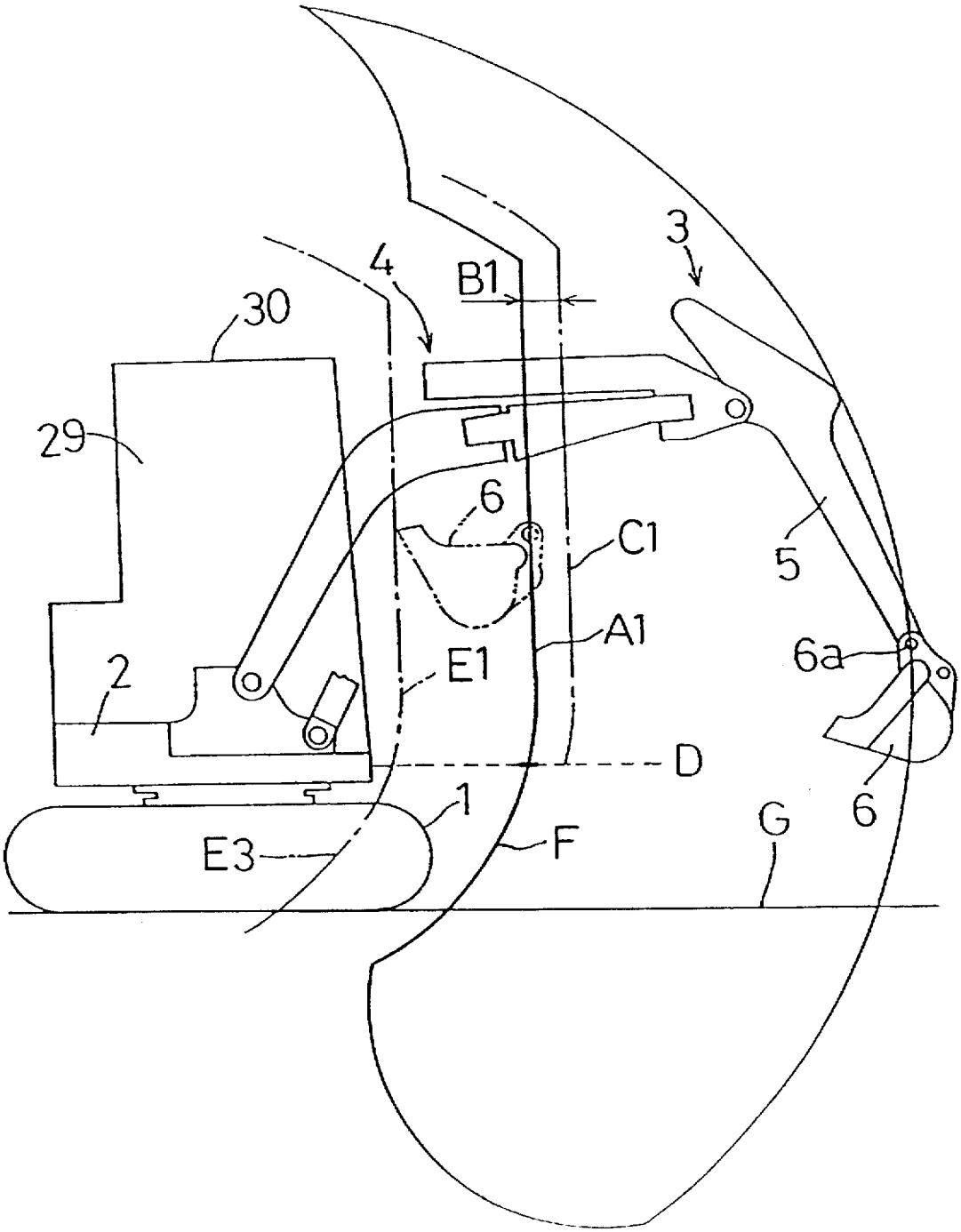
FIG. 2 is a schematic side view of the backhoe, showing a front danger plane, a front danger zone and a front caution plane.

As shown in FIGS. 2 and 4, a front danger plane A1 is defined above a predetermined level D over the ground G and at a predetermined distance forward (outward) from the vertical partition plate 29. Further, as shown in FIG. 4, a side danger plane A2 is defined at a predetermined distance rightward (outward) from a side surface of the vertical partition plate 29 opposed to the boom assembly 3. These danger planes A1 and A2, are set up by the control unit 19.

The bucket 6 is connected to a distal end of the arm 5 through a bucket pin 6*a*. As shown in FIG. 2, the front danger plane A1 is defined such that, when the bucket 6 is brought closest to the driver's section 27 with the bucket pin 6*a* lying on the front danger plane A1, a tip end of the bucket 6 is on a locus E1 having a predetermined distance from the vertical partition plate 29. As shown in FIG. 4, the side danger plane A2 is defined such that, when the bucket 6 is brought closest to the driver's section 27 with the bucket pin 6*a* lying on the side danger plane A2, a side surface of the bucket 6 is on a locus E2 having a predetermined distance from the vertical partition plate 29. Further, caution planes C1 and C2 are defined, each at a predetermined distance forward or rightward from the front or side danger plane A1 or A2. Spaces between the caution planes C1 and C2 and front and side danger planes A1 and A2 are set up by the control unit 19 as front and side danger zones B1 and B2, respectively.

The backhoe may engage in an operation to excavate the ground G with the boom assembly 3 disposed generally below the predetermined level D. In this case, there is a limitation to movement of the boom assembly 3 toward the running device 1. This mechanical operating limitation of the boom assembly 3 itself is determined in advance. A locus described by the bucket pin 6*a* when the boom assembly 3 is operated in the above limit condition is also computed in advance. As shown in FIG. 2, a boundary plane F is defined below the predetermined level D, which is also set up by the control unit 19. The boundary plane F has a small margin (outward) with respect to the locus of the bucket pin 6*a* in the limit condition, and is smoothly continuous with the front danger plane A1. When the bucket 6 is brought closest to the running device 1 with the bucket pin 6*a* lying on the boundary plane F, the tip end of the bucket 6 is on a locus E3.

The above front and side danger planes A1 and A2, front and side danger zones B1 and B2 and boundary plane F are set up in relation to the swivel deck 2. Thus, these planes and zones are movable with the swivel deck 2 in swiveling movement.

Controls of the boom assembly 3 with respect to the front and side danger planes A1 and A2 and front and side danger zones B1 and B2 will be described next with reference to the flowchart shown in FIG. 6.

At step S1, the control unit 19 shown in FIG. 5 constantly computes positions of the bucket pin 6*a* from a vertical angle of the boom 4 (first boom portion 4*a*), a horizontal angle of the second boom portion 4*b* and a fore and aft angle of the arm 5 based on the signals inputted from the potentiometers 36–38, and from lengths of the first boom portion 4*a*, second boom portion 4*b* and arm 5.

At step S2, the control unit 19 checks whether the bucket pin 6*a* is above the predetermined level D or not. If the bucket pin 6*a* is at or above the predetermined level D, the operation proceeds to step S3. If the bucket pin 6*a* is below the predetermined level D, the operation proceeds to step S8.

At step S3, the control unit 19 checks whether the bucket pin 6*a* is inside the front or side danger zone B1 or B2. If the bucket pin 6*a* is outside the danger zones B1 and B2, the hydraulic cylinders 11, 12 and 7 are operable in a normal way, at the rates corresponding to operation of the right and left control levers 9 and 10 and control pedal 26. Step S4 is executed when the bucket pin 6*a* is found, at step S3, to be inside the front or side danger zone B1 or B2.

Figure 3:
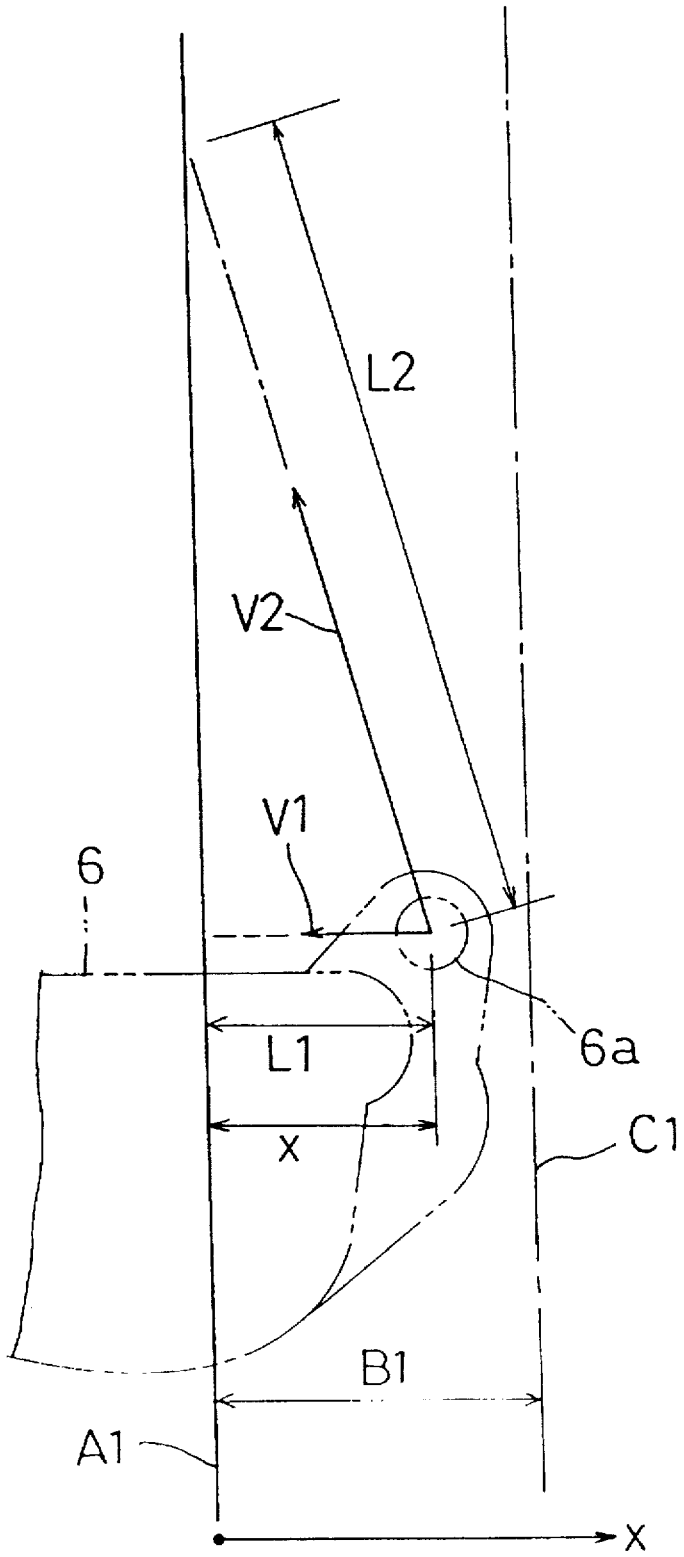
FIG. 3 is a side view of a bucket moving in the front danger zone.

At step S4, the control unit 19 computes a current direction and velocity of movement of the bucket pin 6*a* as velocity vector V1 or V2, as shown in FIGS. 1 and 3, by differentiating detection values provided by the potentiometers 36–38.

At step S5, the control unit 19 computes, from the current position and velocity vector V1 or V2 of the bucket pin 6*a*, a distance L1 or L2 along the velocity vector V1 or V2 from the current position of the bucket pin 6*a* to the front or side danger plane A1 or A2.

At step S6, the control unit 19 computes time T1 or T2 expected to be taken for the bucket pin 6*a* to move from the current position to the front or side danger plane A1 or A2, based on the distance L1 or L2 and taking into account a predetermined deceleration rate for the current velocity vector V1 or V2. This deceleration rate means a negative acceleration rate, which basically is set to a fixed value. In this way, the control unit 19 determines the current position, velocity vector V1 or V2, and estimated time T1 or T2 needed to reach the front or side danger plane A1 or A2.

Figure 8:
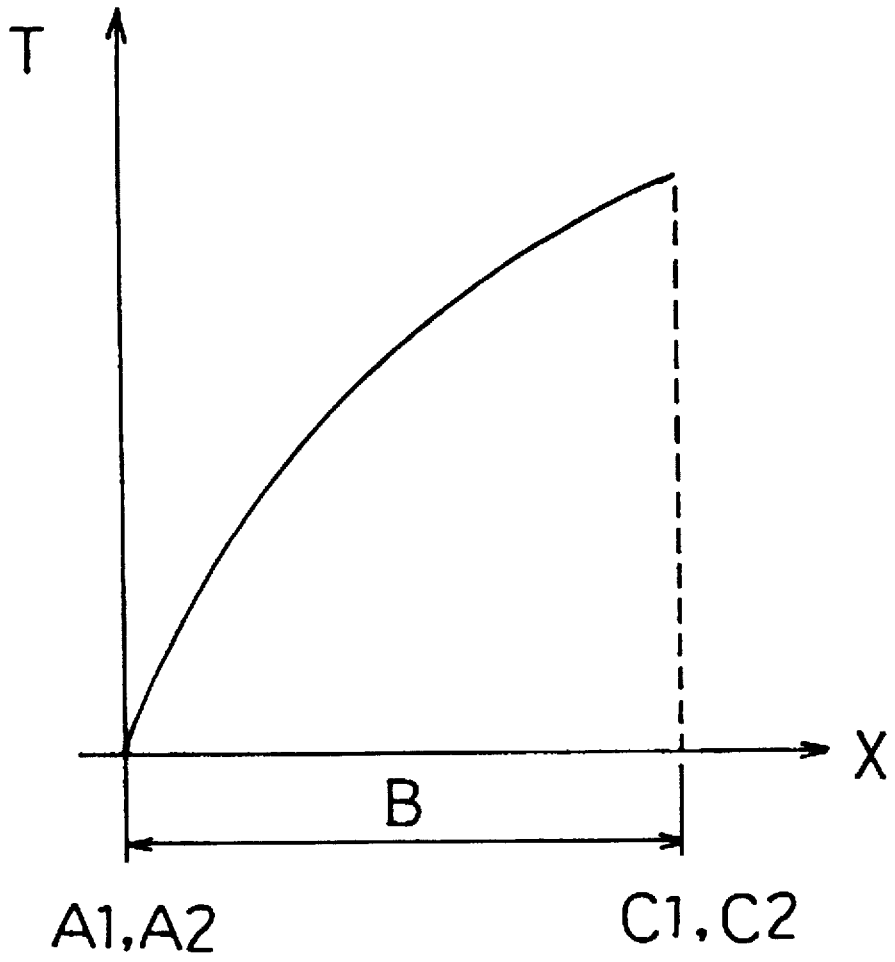
FIG. 8 is a view showing a relationship between a predetermined time and a horizontal distance of the bucket pin to the danger planes.

At step S7, the pilot pressures of the pilot valves 31*a*, 31*b*, 32*a*, 32*b*, 35*a* and 35*b* are lowered to reduce the opening degrees of control valves 21, 22 and 25. As a result, the hydraulic cylinders 11, 12 and 7 are slowed down to equalize the time T1 or T2 substantially to a predetermined time T(x). The predetermined time T(x) is time taken for the bucket pin 6*a* to move from current position "x" to the danger plane A1 or A2 in an ideal, uniformly accelerated motion having a predetermined deceleration rate. This predetermined time T(x) is set as a continuous function of a minimum horizontal distance "x" of the bucket pin 6*a* to the front or side danger plane A1 or A2. FIG. 8 shows a typical example thereof. As seen from FIG. 8, the predetermined time T(x) becomes progressively shorter toward the front or side danger plane A1 or A2. Assuming the bucket pin 6*a* is the danger zone B1, B2 and is moving towards the driver's section 27, the time consumed before the bucket pin 6*a* stops at the danger plane A1 or A2 is adjusted only on the basis of the horizontal distance "x" of the bucket pin 6*a* to the danger plane A1 or A2, regardless of the direction of movement of the bucket pin 6*a*.

As shown in FIG. 3, the bucket pin 6*a* is at distance L1 to the front or side danger plane A1 or A2 when the bucket pin 6*a* has velocity vector V1, and at distance L2 when the bucket pin 6*a* moves towards the driver's section 27 has velocity vector V2. Although distance L1 is shorter than distance L2, the predetermined time T when the bucket pin 6*a* has velocity vector V1 has the same value as the predetermined time T(x) when the bucket pin 6*a* has velocity vector V2.

Thus, the hydraulic cylinders 11, 12 and 7 are decelerated when the bucket pin 6a is inside the front or side danger zone B1 or B2. This control is based on the constant computation of the current position, velocity vector V1 or V2, and estimated time T1 or T2 needed to reach the front or side danger plane A1 or A2. As a result, the bucket pin 6a reaches the front or side danger plane A1 or A2 after the predetermined time T(x) whether the bucket pin 6a moves horizontally, obliquely upward or obliquely downward from the current position.

Conversely, the hydraulic cylinders 11, 12 and 7 are accelerated when the boom assembly 3 is operated in a direction to move the bucket pin 6a in the front or side danger zone B1 or B2 and away from the front or side danger plane A1 or A2. Once the bucket pin 6a is out of the danger zone B1 or B2, the normal speed is restored.

Figure 6:
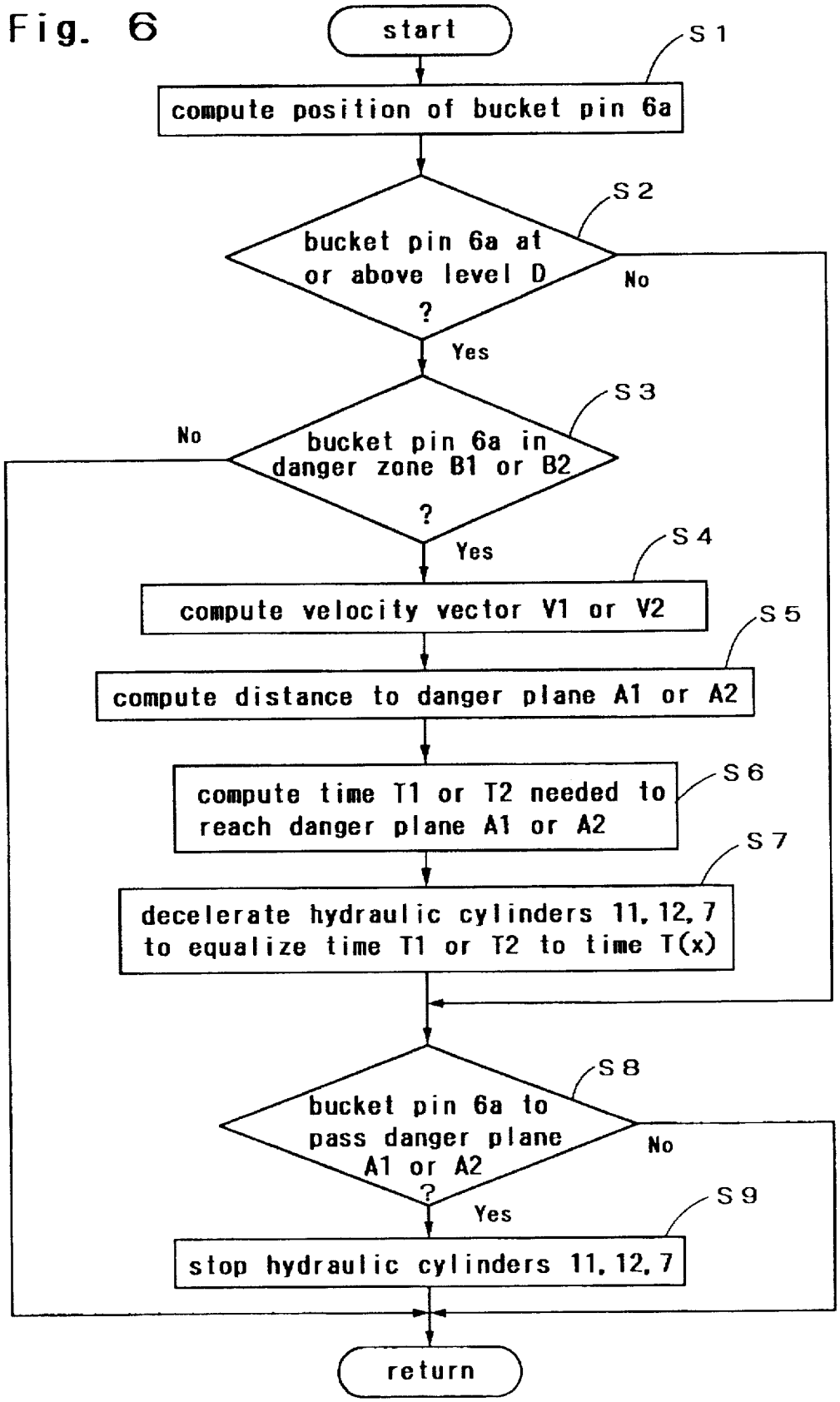
FIG. 6 is a flowchart of boom assembly controls effected when a bucket pin is on the front or side danger plane and in the front or side danger zone.
Figure 7:
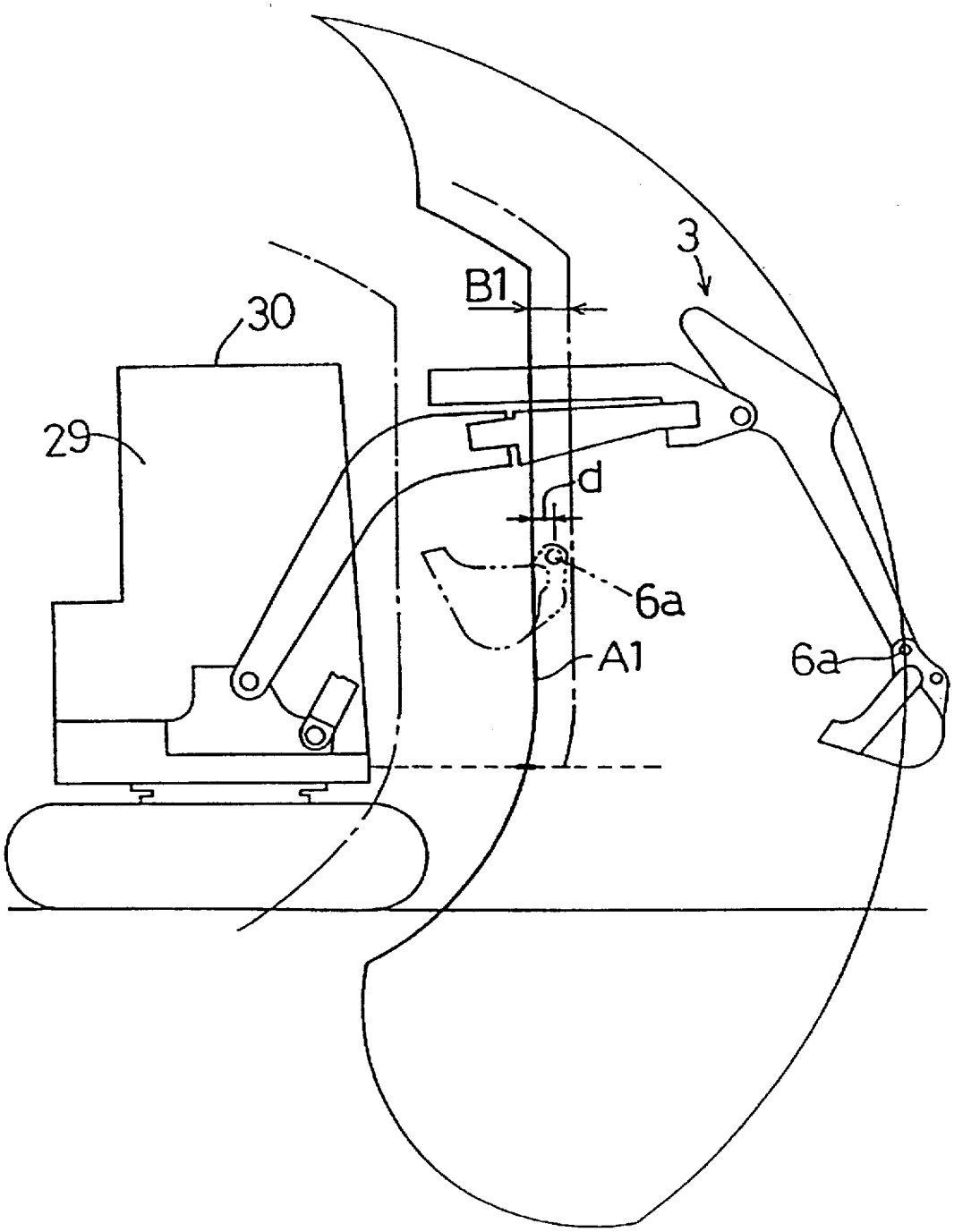
Fig. 7 PRIOR ART
FIG. 7 is a schematic side view of a backhoe, showing a front danger plane and a front danger zone according to the prior art.

If, at step S8 in FIG. 6, the operation is continued to move the bucket pin 6a even slightly past the front or side danger plane A1 or A2 toward the driver's section 27, the next step S9 is executed to eliminate the pilot pressures of pilot valves 31a–32b, 35a and 35b for causing the control valves 21, 22 and 25 to stop the hydraulic cylinders 11, 12 and 7 of the boom assembly 3. Thus, step S9 in FIG. 6 may be termed safety means. The hydraulic cylinder 13 for actuating the bucket 6 is still operable when the bucket pin 6a is on the from or side danger plane A1 or A2. In this condition, the boom assembly 3 may be operated in a way to cause the bucket pin 6a to move at ultra-slow speed along the danger plane A1 or A2.

As described above, the front and side danger zones B1 and B2 are defined above the predetermined level D shown in FIG. 2. Such front and side danger zones are not defined below the predetermined level D. Thus, when the bucket pin 6a is below the predetermined level D, the operation jumps from step S2 to step S8. In this case, the hydraulic cylinders 11, 12 and 7 of the boom assembly 3 are operated at speeds based on operation of the right and left control levers 9 and 10 and control pedal 26 until the bucket pin 6a reaches the boundary plane F. If the operation is continued to move the bucket pin 6a even slightly past the boundary plane F toward the running device 1, the pilot pressures of pilot valves 31 a–32b, 35a and 35b are eliminated for causing the control valves 21, 22 and 25 to stop the hydraulic cylinders 11, 12 and 7 of the boom assembly 3.

The hydraulic cylinder 13 for actuating the bucket 6 is still operable when the bucket pin 6a is on the boundary plane F, to cause the bucket pin 6a to move along the boundary plane F. Thus, after the bucket 6 scoops soil from the ground G adjacent the running device 1, the bucket 6 may be raised along the boundary plane F. With this movement, the bucket pin 6a moves smoothly from the boundary plane F to the from danger plane A1, and enters the front danger zone B1.

(Second Embodiment)

Figure 9:
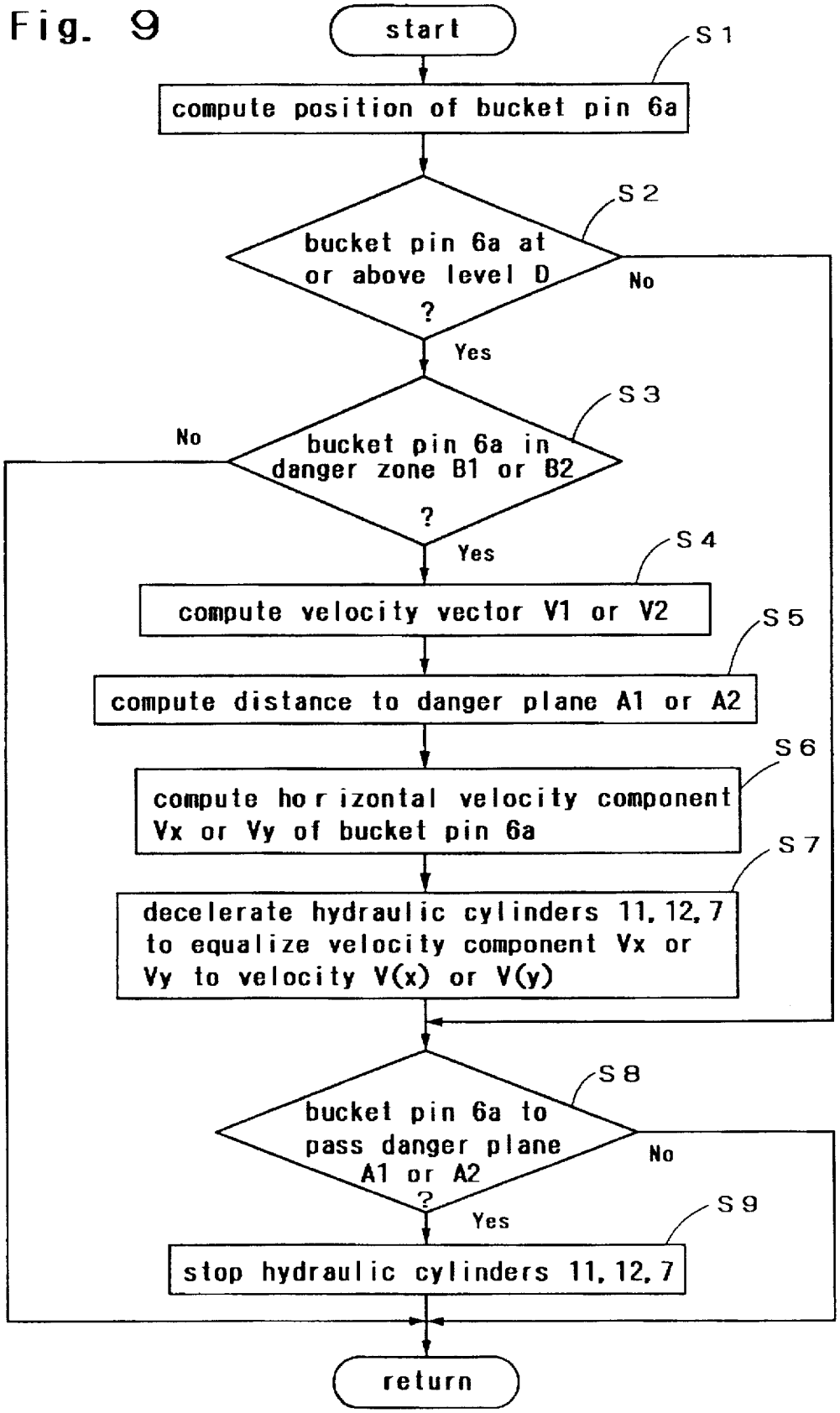
FIG. 9 is a flowchart of boom assembly controls effected when the bucket pin is on the front or side danger plane and in the front or side danger zone, in a second embodiment of the present invention.

FIG. 9 shows a flowchart of boom assembly controls in this embodiment As distinct from the preceding embodiment, this embodiment basically employs, instead of the predetermined time T(x), a velocity V(x) for realizing the predetermined time T(x). The hydraulic cylinders 11, 12 and 7 are decelerated when the bucket pin 6a is in the danger zone B1 or B2, to equalize an actual reduced velocity to the predetermined velocity V(x).

That is, in the preceding embodiment, a position and direction and velocity of movement of the bucket pin 6a are computed at steps S4 and S5. The predetermined time needed for the bucket pin 6a to move in an ideal, uniformly accelerated motion and stop at the danger plane A1 is given as a function of a horizontal distance of the bucket pin 6a to the front danger plane A1. The hydraulic cylinders 11, 12 and 7 are decelerated so that the time the bucket pin 6a is expected to consume in moving from the current instantaneous position "x" to the danger plane A1 agree with the predetermined time expressed as a function of a horizontal distance.

Instead of setting the stopping time T(x) based on the ideal, uniformly accelerated motion as in the preceding embodiment, the second embodiment employs an ideal velocity V(x) of the bucket pin 6a inside the danger zone to realize a predetermined, ideal, uniformly accelerated motion. In other words, assuming an ideal motion by which the bucket pin 6a moves horizontally at a predetermined velocity into the danger zone B1 having a width (horizontal distance) defined by the caution plane C1 and danger plane A1, moves at a uniform deceleration through the danger zone B1 and stops at the danger plane A1, a velocity of the bucket pin 6a for realizing an ideal motion in a given position "x" within the danger zone B1 is determined by a horizontal distance "x" of the bucket pin 6a from the danger plane A1. Thus, this embodiment sets a decelerated motion of uniform acceleration having an ideal initial velocity of the bucket pin 6a as noted above. The hydraulic cylinders 11, 12 and 7 are operated to approximate the decelerated motion of the bucket pin 6a to the above ideal, uniformly accelerated motion when the pin 6a moving at varied velocities and in varied directions enters the danger zone B1 and advances toward the danger plane A1.

The bucket pin 6a enters the danger zone B1 with a maximum degree of freedom at 180 degrees to the caution plane C1 in side view and at 180 degrees thereto in plan view. It is therefore necessary to compute a component Vx in the direction of x-axis of the velocity of the bucket pin 6a in order to check with the ideal velocity. The x-axis is set in relation to the swivel deck 2, and is movable with the swivel deck 2 in swiveling movement.

Thus, at step S6 in this embodiment, the x-axis component Vx of the moving velocity V of the bucket pin 6a is derived from the values computed at steps S4 and S5.

Next, at step S7, the hydraulic cylinders 11, 12 and 7 are decelerated to equalize the x-axis velocity component Vx of the bucket pin 6a computed above to the ideal velocity V(x). This is carried out every unit time $\Delta t$ until the bucket pin 6a reaches the danger plane A1.

Needless to say, the closer the bucket pin 6a moves to the danger plane A1, the lower becomes the predetermined velocity V(x). The velocity of the bucket pin 6a is adjusted only on the basis of a distance in the direction of x-axis (horizontal and minimum) to the danger plane A1, regardless of the direction of movement of the bucket pin 6a.

The control unit 19 has decelerating means to effect the greater deceleration of hydraulic cylinders 11, 12 and 7, the closer the bucket pin 6a in the danger zone B1 moves to the front danger plane A1.

When the bucket pin 6a is in the danger zone B2 also, the hydraulic cylinders 11, 12 and 7 are decelerated to substantially equalize a velocity component Vy in y-axis direction of the bucket pin 6a to an ideal, uniformly accelerated motion set as above. Again, the y-axis is set in relation to the swivel deck 2, and is movable with the swivel deck 2 in swiveling movement.

(Third Embodiment)

Figure 10:
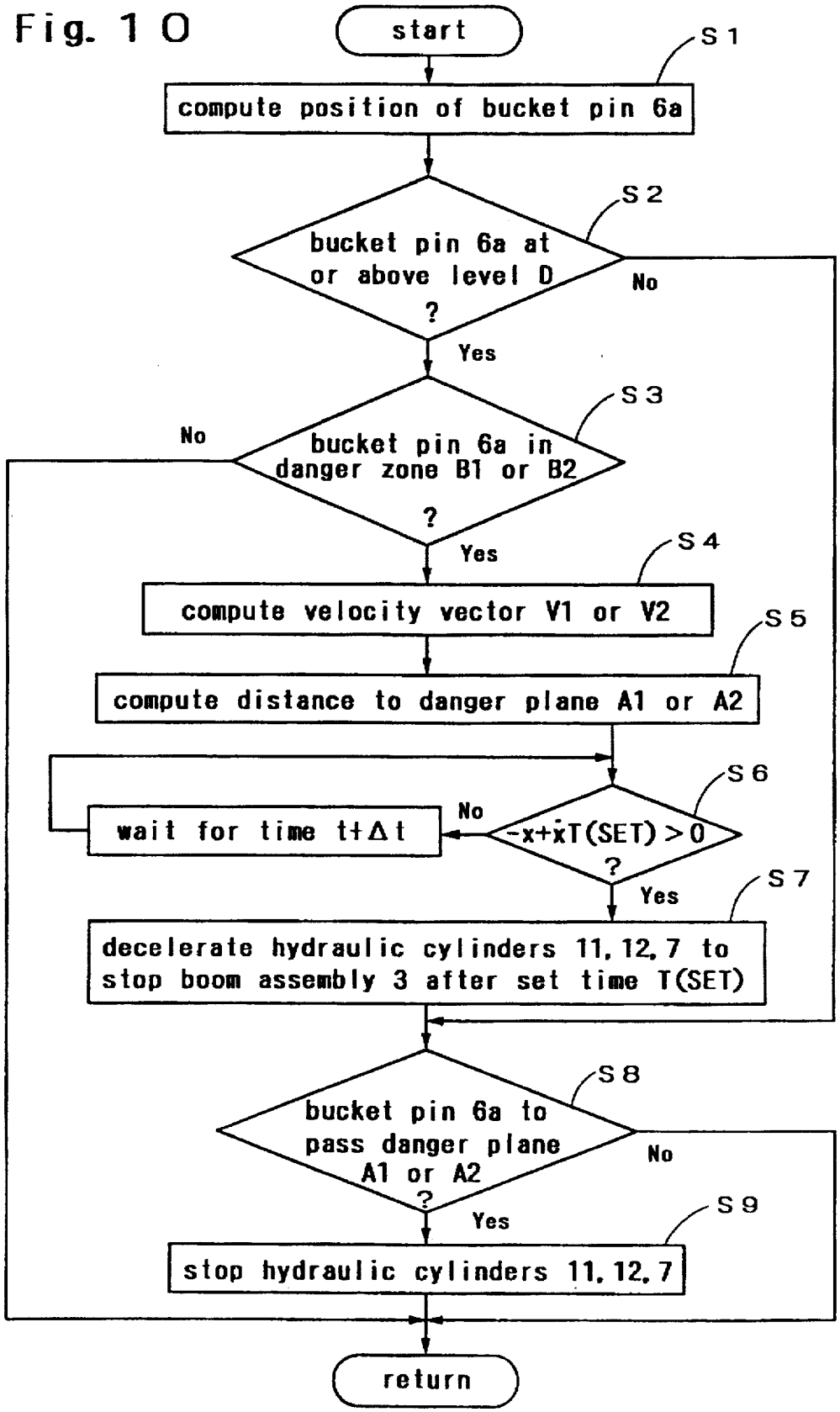
FIG. 10 is a flowchart of boom assembly controls effected when the bucket pin is on the front or side danger plane and in the front or side danger zone, in a third embodiment of the invention.

FIG. 10 shows a flowchart of boom assembly controls in this embodiment. This embodiment basically is the same as the first embodiment up to step S5 in the flowchart, with the following steps S6 and S7 employed in this embodiment.

At step S6, the following operation is carried out to determine whether the left term is larger than zero or not:

$$x+XT(SET)>0$$

where x is a distance of the bucket pin along a direction of movement to the danger plane A1 or A2, x is the value of an instantaneous velocity vector of the bucket pin, and T(SET) is set time required for a set stop. Generally, the set time T(SET) is 0.5 to 0.6 seconds. When the left term in the above expression is larger than zero, it is considered possible that, if the motion of the bucket pin 6a having the velocity and direction of the instant continues for the set time T(SET), the bucket pin 6a moves inwardly of the danger plane A1 or A2. Then, the next step S7 is executed.

At step S7, deceleration of the hydraulic cylinders 11, 12 and 7 is started, simultaneously with the decision made at step S6, to control the boom assembly 3.

If, at step S6, the above expression is not satisfied, i.e. if the left term in the above expression is found smaller than zero, it is considered that the bucket pin 6a will not move inwardly of the danger plane A1 or A2 even if the motion of the bucket pin 6a having the velocity and direction of the instant continues for the set time T(SET). Then, the hydraulic cylinders 11, 12 and 7 are not decelerated but the bucket 6 is allowed to maintain the motion of the instant although the bucket pin 6a is inside the danger zone B1 or B2.

The operation of step S6 is repeated the next instant, i.e. upon lapse of Δt seconds. If the above expression is satisfied at this time, the hydraulic cylinders 11, 12 and 7 are decelerated immediately. In sum, though the bucket pin 6a is inside the danger zone B1 or B2, the boom assembly 3 may continue to operate without being decelerated until the above expression is satisfied.

Thus, whether the bucket pin 6a has velocity vector V1 or velocity vector V2 as shown in FIG. 3, the bucket 6 is decelerated only when the bucket pin 6a with either velocity is considered to move past the danger plane upon lapse of set time T(SET) seconds. Once the deceleration control is initiated, whether the bucket pin 6a has velocity vector V1 or V2, the bucket pin 6a stops substantially in the set time T(SET) seconds. Consequently, even when the bucket pin 6a inside the danger zone B1 or B2 has a large angle to the danger plane A1 or A2, the bucket pin 6a will not move for an excessively long time before stopping. The set time T(SET) may have a value best suited to the operator.

(Fourth Embodiment)

In the first to third embodiments described above, the front and side danger plane A1 and A2 are determined with reference to a position of the bucket pin 6a as shown in FIG. 2. Alternatively, a potentiometer (not shown) may be installed adjacent the bucket pin 6a to enable the control unit 19 to constantly compute positions of the tip end of the bucket 6. In this case, the loci C1 and C2 shown in FIGS. 2 and 4 define the danger planes according to the present invention.

In the preceding embodiments, the potentiometers 36–38 are used to determine the position and velocity vector V1 or V2 of the bucket pin 6a. These potentiometers 36–38 may be used exclusively for detecting a position of the bucket pin 6a, with velocity vector V1 or V2 detected by means of other sensors.

What is claimed is:

1. A backhoe having a swivel deck supporting a driver's section (27) and a boom assembly driven by hydraulic cylinders and carrying a bucket (6) connected to a distal end thereof, comprising:

boom assembly drive means for driving a boom of said boom assembly through said hydraulic cylinders;

detecting means for detecting a position, direction of movement and velocity of movement of said bucket (6) relative to said driver's section (27), said detecting means including:

a position detecting member for detecting the position of said bucket;

a direction detecting member for detecting the direction of movement of said bucket; and a velocity detecting member for detecting the velocity of movement of said bucket; and control means for controlling a motion of said bucket (6) through said boom assembly drive means in response to input values from said detecting means, said control means having a function to prohibit operation of said bucket (6) when said bucket (6) lies inwardly of a danger plane (A1, A2) disposed at a predetermined distance outwardly of an outer frame (29, 30) defining an outermost region of said driver's section (27);

characterized in that said control means:

A. establishes a danger zone (B1, B2) surrounded by said danger plane (A1, A2) and a caution plane (C1, C2) disposed at a predetermined distance outwardly of said danger plane (A1, A2);

B. includes decelerating means operable, when said bucket (6) lies in said danger zone (B1, B2), to decelerate operation of said hydraulic cylinders to substantially equalize time taken for said bucket (6) to reach said danger plane (A1, A2) to a set time towards said danger plane (A1, A2), said decelerating means remaining inoperative when said bucket (6) lies in said danger zone (B1, B2) and moves away from said driver's section (27);

C. includes set value determining means operable, when said bucket (6) lies in said danger zone (B1, B2), to set time for stopping said bucket (6) by using, as a parameter, a minimum distance of said bucket (6) from said danger plane (A1, A2); and D. includes time estimating means operable, when said bucket (6) lies in said danger zone (B1, B2), to compute time taken for said bucket (6) to move from a current position thereof to said danger plane (A1, A2) based on detection values provided by'said detecting means;

said decelerating means being operable, when said bucket (6) lies in said danger zone (B1, B2) and moves toward said danger plane (A1, A2), to decelerate operation of said hydraulic cylinders so that the time estimated by said time estimating means agrees with the set value determined by said set value determining means; and said decelerating means being operable, the higher said velocity of movement is, to decelerate operation of said hydraulic cylinders by a greater degree.

2. A backhoe as defined in claim 1, wherein the set value determined by said set value determining means has a positive correlation with said minimum distance of said bucket (6) from said danger plane (A1, A2).

3. A backhoe having a swivel deck supporting a driver's section (27) and a boom assembly driven by hydraulic cylinders and carrying a bucket (6) connected to a distal end thereof, comprising:

boom assembly drive means for driving a boom of said boom assembly through said hydraulic cylinders;

detecting means for detecting a position, direction of movement and velocity of movement of said bucket (6) relative to said driver's section (27), said detecting means including:

a position detecting member for detecting the position of said bucket;

a direction detecting member for detecting the direction of movement of said bucket; and a velocity detecting member for detecting the velocity of movement of said bucket; and control means for controlling a motion of said bucket (6) through said boom assembly drive means in response to input values from said detecting means, said control means having a function to prohibit operation of said bucket (6) when said bucket (6) lies inwardly of a danger plane (A1, A2) disposed at a predetermined distance outwardly of an outer frame (29, 30) defining an outermost region of said driver's section (27);

characterized in that said control means:

A. establishes a danger zone (B1, B2) surrounded by said danger plane (A1, A2) and a caution plane (C1, C2) disposed at a predetermined distance outwardly of said danger plane (A1, A2);

B. includes decelerating means operable, when said bucket (6) lies in said danger zone (B1, B2), to decelerate operation of said hydraulic cylinders to substantially equalize time taken for said bucket (6) to reach said danger plane (A1, A2) to a set time towards said danger plane (A1, A2);

C. includes set value determining means operable, when said bucket (6) lies in said danger zone (B1, B2), to set a velocity value of said bucket (6) by using, as a parameter, a minimum distance of said bucket (6) from said danger plane (A1, A2); and D. computes a velocity component in a direction of said minimum distance of said velocity of movement of said bucket (6) in said danger zone (B1, B2) based on detection values provided by said detecting means;

E. said decelerating means being operable to decelerate operation of said hydraulic cylinders so that said velocity component agree with said set velocity value.

4. A backhoe as defined in claim 3, wherein the set velocity value determining means has a positive correlation with said minimum distance of said bucket (6) from said danger plane (A1, A2).

5. A backhoe having a swivel deck supporting a driver's section (27) and a boom assembly driven by hydraulic cylinders and carrying a bucket (6) connected to a distal end thereof, comprising:

boom assembly drive means for driving a boom of said boom assembly through said hydraulic cylinders;

detecting means for detecting a position, direction of movement and velocity of movement of said bucket (6) relative to said driver's section (27), said detecting means including:

a position detecting member for detecting the position of said bucket;

a direction detecting member for detecting the direction of movement of said bucket; and a velocity detecting member for detecting the velocity of movement of said bucket; and control means for controlling a motion of said bucket (6) through said boom assembly drive means in response to input values from said detecting means, said control means having a function to prohibit operation of said bucket (6) when said bucket (6) lies inwardly of a danger plane (A1, A2) disposed at a predetermined distance outwardly of an outer frame (29, 30) defining an outermost region of said driver's section (27);

characterized in that said control means:

A. establishes a danger zone (B1, B2) surrounded by said danger plane (A1, A2) and a caution plane (C1, C2) disposed at a predetermined distance outwardly of said danger plane (A1, A2);

B. includes decelerating ,means operable, when said bucket (6) lies in said danger zone (B1, B2), to decelerate operation of said hydraulic cylinders to substantially equalize time taken for said bucket (6) to reach said danger plane (A1, A2) to a set time towards said danger plane (A1, A2);

C. includes set value determining means operable, when said bucket (6) lies in said danger zone (B1, B2), to set time for stopping said bucket (6);

D. includes time estimating means operable, when said bucket (6) lies in said danger zone (B1, B2), to compute time taken for said bucket (6) to move from a current position thereof to said danger plane (A1, A2) based on detection values provided by said detecting means; and E. includes comparison operating means for comparing the time estimated by said time estimating means and the set value determined by said set value determining means;

F. said decelerating means being operable to decelerate operation of said hydraulic cylinders when the time estimated by said time estimating means is smaller than the set value determined by said set value determining means.

6. A backhoe as defined in claim 5, wherein said set value is arbitrarily selectable.

7. A backhoe as defined in claim 5, wherein the time estimated is based on an instantaneous velocity and the current position of said bucket detected by said detecting means.

8. A backhoe as defined in claim 5, wherein said decelerating means remains inoperative when said time estimated is greater than said set value, even if said bucket (6) lies in said danger zone (B1, B2).

9. A backhoe having a swivel deck supporting a driver's section (27) and a boom assembly driven by hydraulic cylinders and carrying a bucket (6) connected to a distal end thereof, comprising:

boom assembly drive means for driving a boom of said boom assembly through said hydraulic cylinders;

detecting means for detecting a position, direction of movement and velocity of movement of said bucket (6) relative to said driver's section (27), said detecting means including:

a position detecting member for detecting the position of said bucket;

a direction detecting member for detecting the direction of movement of said bucket; and a velocity detecting member for detecting the velocity of movement of said bucket; and control means for controlling a motion of said bucket (6) through said boom assembly drive means in response to input values from said detecting means, said control means having a function to prohibit operation of said bucket (6) when said bucket (6) lies inwardly of a danger plane (A1, A2) disposed at a predetermined distance outwardly of an outer frame (29, 30) defining an outermost region of said driver's section (27);

characterized in that said control means:

A. establishes a danger zone (B1, B2) surrounded by said danger plane (A1, A2) and a caution plane (C1, C2) disposed at a predetermined distance outwardly of said danger plane (A1, A2); and B. includes decelerating means operable, when said bucket (6) lies in said danger zone (B1, B2), to decelerate operation of said hydraulic cylinders to substantially equalize time taken for said bucket (6) to reach said danger plane (A1, A2) to a set time towards said danger plane (A1, A2);

C. includes set value determining means operable, when said bucket (6) lies in said danger zone (B1, B2), to set time for stopping said bucket (6) by using, as a parameter, a minimum distance of said bucket (6) from said danger plane (A1, A2); and D. includes time estimating means operable, when said bucket (6) lies in said danger zone (B1, B2), to compute time taken for said bucket (6) to move from a current position thereof to said danger plane (A1, A2) based on detection values provided by said detecting means;

E. said decelerating means being operable, when said bucket (6) lies in said danger zone (B1, B2) and moves; toward said danger plane (A1, A2), to decelerate operation of said hydraulic cylinders so that the time estimated by said time estimating means agree with the set value determined by said set value determining means;

wherein said decelerating means remains inoperative when said bucket (6) lies in said danger zone (B1, B2) and moves; away from said driver's section (27).

* * * * *